United States Patent [19]

Ura et al.

[11] Patent Number: 4,878,657

[45] Date of Patent: Nov. 7, 1989

[54] SHEET CONVEYANCE APPARATUS

[75] Inventors: Hiroaki Ura; Takao Shiozawa, both of Hachioji, Japan

[73] Assignee: Konica Corporation, Tokyo, Japan

[21] Appl. No.: 135,435

[22] Filed: Dec. 21, 1987

[30] Foreign Application Priority Data

| | | | |
|---|---|---|---|
| Dec. 24, 1986 | [JP] | Japan | 61-310034 |
| Dec. 24, 1986 | [JP] | Japan | 61-201993 |
| Dec. 24, 1986 | [JP] | Japan | 61-201995 |
| Dec. 24, 1986 | [JP] | Japan | 61-201997 |
| Jan. 20, 1987 | [JP] | Japan | 62-11164 |

[51] Int. Cl.[4] ..... B65H 3/44; B65H 5/26; B65H 9/04; G03G 21/00

[52] U.S. Cl. ..... 271/9; 271/242; 355/30; 355/215; 355/317

[58] Field of Search ..... 355/3 SH, 3 TR, 14 SH, 355/30, 215, 317; 271/227, 242, 245, 265, 9

[56] References Cited

U.S. PATENT DOCUMENTS

| | | | |
|---|---|---|---|
| 3,949,979 | 4/1976 | Taylor et al. | 271/245 X |
| 4,350,436 | 9/1982 | Yagasaki et al. | 355/14 SH |
| 4,407,219 | 10/1983 | Dellevoet | 355/3 FU X |
| 4,411,042 | 10/1983 | Sakata et al. | 355/15 X |
| 4,548,394 | 10/1985 | Koyama et al. | 271/242 X |
| 4,708,456 | 11/1987 | Shibata et al. | 355/3 SH |

*Primary Examiner*—Fred L. Braun

*Attorney, Agent, or Firm*—Frishauf, Holtz, Goodman & Woodward

[57] ABSTRACT

A sheet conveyance apparatus composed of a unit which is driven independently of an image forming part of the electrophotographic copying apparatus. The sheet conveyance apparatus is disposed between a sheet feed apparatus and the image-forming part having a photoreceptor on the electrographic copying apparatus. A loop is consistently maintained on the sheet as it is transported within the sheet conveyance apparatus which also includes registration rollers incorporated therein. After the loop is formed, the sheet is stopped at the registration rollers to correct skew. Then, the registration rollers convey the sheet to the image-forming part.

11 Claims, 9 Drawing Sheets

SHEET CONVEYANCE APPARATUS

BACKGROUND OF THE INVENTION

The present invention relates to a sheet conveyance apparatus which is mounted onto an electrophotographic copying apparatus or the like, and, in particular, to a reliable sheet conveyance apparatus wherein, even rollers rollers which are transporting copying sheets during a conveyance step are driven respectively with a different speed, an excessively large force is nevertheless not exerted on a copying sheet, and a copying sheet conveyed with an askew orientation being may be easily corrected.

Conventionally, when transporting a copying sheet from a sheet feed apparatus to an apparatus such as an electrophotographic copying apparatus, the sheets fed from the sheet feed apparatus are sheet by sheet further transported to registration rollers disposed on the electrophotographic copying apparatus, thereby the registration rollers are activated at a specific timing in order to transfer the sheets.

A conventional copying sheet conveyance apparatus has the following disadvantages. During the sheet conveyance, when conveyance rollers fail to transport a copying sheet with a uniform conveyance speed, the sheet becomes slack or excessively tight. Or, if the positional relation between an image forming member and a registration roller is not set in correct position, the copying sheet may be transported askew, and if this misoriented sheet is further transported without any correction, the finally formed image will be adversely affected. In order to solve these problems, conventionally, a conveying part extending from the sheet feeding part, including the sheet cassette, to the registration part, including the registration roller, is integrally constructed to form one unit, and then the positional relation between such unit and the image forming member is adjusted to set them into the correct position. However, since the above-described unit becomes too big in size, it may be difficult to move to adjust its setting. Further, in recent years, the sheet feeding part and the sheet conveyance part of a copy machine capable of handling a great number of sheets has become large in size. Accordingly, setting such adjustment becomes more difficult.

The present invention further relates to a sheet conveyance apparatus which is not adversely affected by a fluctuating load in the main body of the electrophotographic copying apparatus. Namely, when feeding a copying sheet from a sheet feed apparatus to an apparatus such as an electrophotographic copying apparatus, the copying sheets fed from the sheet feed apparatus are transported sheet by sheet to a registration roller disposed in the electrophotographic copying apparatus or the like, wherein the registration roller is actuated at specific timing in order to further transport the sheets.

During this sheet conveyance operation, a driving force of a driving unit is used also for driving an image-carrying member on the electrophotographic copying apparatus. The driving force is transmitted to a registration clutch which actuates or stops the registration roller.

With a sheet conveyance apparatus having the above-mentioned arrangement, however, the driving force for driving the registration roller is derived from the driving unit for the main body of the electrophotographic copying apparatus and is adversely affected by the fluctuation in load being exerted on the image-carrying member. Thus, the rotation of the registration roller is adversely affected. Accordingly, the line speed of the registration roller is not always constant, thereby adversely affecting the finally formed image.

Therefore, one object of the present invention is to provide a sheet conveyance apparatus, which is a unit independent of an electrophotographic copying apparatus and is arranged at the portion between the sheet feed apparatus and the imageforming portion on the electrophotographic copying apparatus, and contains the registration roller, wherein the sheet conveyance apparatus is not adversely affected by the load fluctuation of the main body of the electrophotographic copying apparatus and is free from the imaging failure in the course of an image forming operation because the sheet conveyance apparatus is provided with a driving unit, independent of the electrophotographic copying apparatus, for driving a conveyance roller and a registration roller.

SUMMARY OF THE INVENTION

The present invention is intended to overcome the above-mentioned problems which a conventional copying sheet conveyance apparatus inherently has, and, therefore, the object of the invention is to provide a sheet conveyance apparatus composed of a unit and being independent of the electrophotographic copying apparatus, wherein the sheet conveyance apparatus is disposed between a sheet feed apparatus and an image-forming area on the electrophotographic copying apparatus, and comprises the registration roller. Accordingly, even if a sheet transporting speed of the sheet conveyance unit differs from that of the sheet feed unit for feeding a sheet to the sheet conveyance unit, in other words, even if there is discrepancy in terms of the transporting speed especially at a unit-to-unit interfacing area, an excessive stretching force is not exerted onto a transported sheet, so that a finally formed image should be free from the degrading effect arisen from the improper sheet conveyance.

Further, the present invention has an object to provide a sheet conveyance apparatus capable of easily making it possible to adjust a positional relation between the image forming member and the registration rollers.

To solve the above problems, the present invention provides a sheet conveyance apparatus which is disposed inside an electrophotographic copying apparatus and conveys a copying sheet fed from a sheet feed apparatus to an image-forming portion of the electrophotographic copying apparatus. More specifically, such a sheet conveyance apparatus has a sheet transporting passage formed with two pairs of upper and lower guide plates which are disposed along the sheet transporting direction at a specific interval, wherein a portion of the passage following from the sheet feed apparatus is provided with a pair of upper and lower conveyance rollers, a portion of the passage to the image-forming apparatus is provided with a pair of upper and lower registration rollers, and a movable portion of a guide plate interfacing with another unit is capable of moving and forming a wider passage.

With a sheet conveyance apparatus of the invention having the above constitution, even if a sheet forms a loop when conveyed due to a transporting speed discrepancy in a unit-to-unit interfacing area in the sheet conveyance apparatus, a copying sheet transported from a sheet feed apparatus to an electrophotographic copying apparatus is free from an excessive slackness or deformation and stably transported, because the stiffness of the loop lifts up a movable portion of the guide plate in order to allow smooth sheet transportation.

Additionally, another object of the present invention is to provide a sheet conveyance apparatus which, even if a copying sheet is misoriented in the course of transportation, ensures a final image to be formed in a correct position on a copying sheet, by shifting the sheet conveyance apparatus in a horizontal plane in order to correct the misorientation in the sheet.

To solve the above problem, the present invention provides a sheet conveyance apparatus, which is an apparatus disposed in the main body of an electrophotographic copying apparatus and transporting a copying sheet fed from a sheet feed apparatus to an image-forming portion on the electrophotographic copying apparatus. More specifically, the sheet conveyance apparatus comprises a passage formed between a pair of upper and lower guide plates, a pair of upper and lower conveyance rollers disposed in the passage, and a pair of upper and lower registration rollers disposed at a downstream side of the conveyance roller, whereby the unit having the abovementioned components is capable of arbitrarily shifting in a horizontal plane relative to the main body of the electrophotographic copying apparatus.

Having the above constitution, the sheet conveyance apparatus of the invention is capable of forming a final image at a correct position on a copying sheet, because the copying sheet transported from a sheet feed apparatus to an apparatus such as an electrophotographic copying apparatus is correctly oriented and transported to the image-forming portion of the electrophotographic copying apparatus by swinging a whole unit of the sheet copying apparatus, even if the sheet is misoriented in the course of transportion.

To eliminate adverse effects caused by the load fluctuation of the main body of the electrophotographic copying apparatus and to be free from the imaging failure in the course of an image forming operation, the present invention proposes a sheet conveyance apparatus which is disposed within the main body of an electrophotographic copying apparatus and transports copying sheets fed by a sheet feed apparatus toward an image-forming portion of the electrophotographic copying apparatus, wherein the sheet conveyance apparatus comprises a passage formed between a pair of upper and lower guide plates, a pair of upper and lower conveyance rollers located in the passage for transporting the copying sheets, a pair of upper and lower registration rollers located in the downstream side of the pair of upper and lower registration rollers and transports the copying sheets in conjunction with the image-forming timing of the image-forming portion, and a driving unit for actuating or stopping the pair of upper and lower registration rollers.

With the above-mentioned construction according to the present invention, the copying sheets fed from the sheet feed apparatus and transported to the electrophotographic copying apparatus or the like are conveyed by a sheet conveyance apparatus provided with an independent driving unit. This means that, unconventionally, a driving force of a driving unit for the main body of the electrophotographic copying apparatus is, not used, whereby the imaging failure due to the load fluctuation on the image-carrying member of the like is positively prevented.

DETAILED DESCRIPTION OF THE PREFERRED EMBODIMENTS

Figure 1:
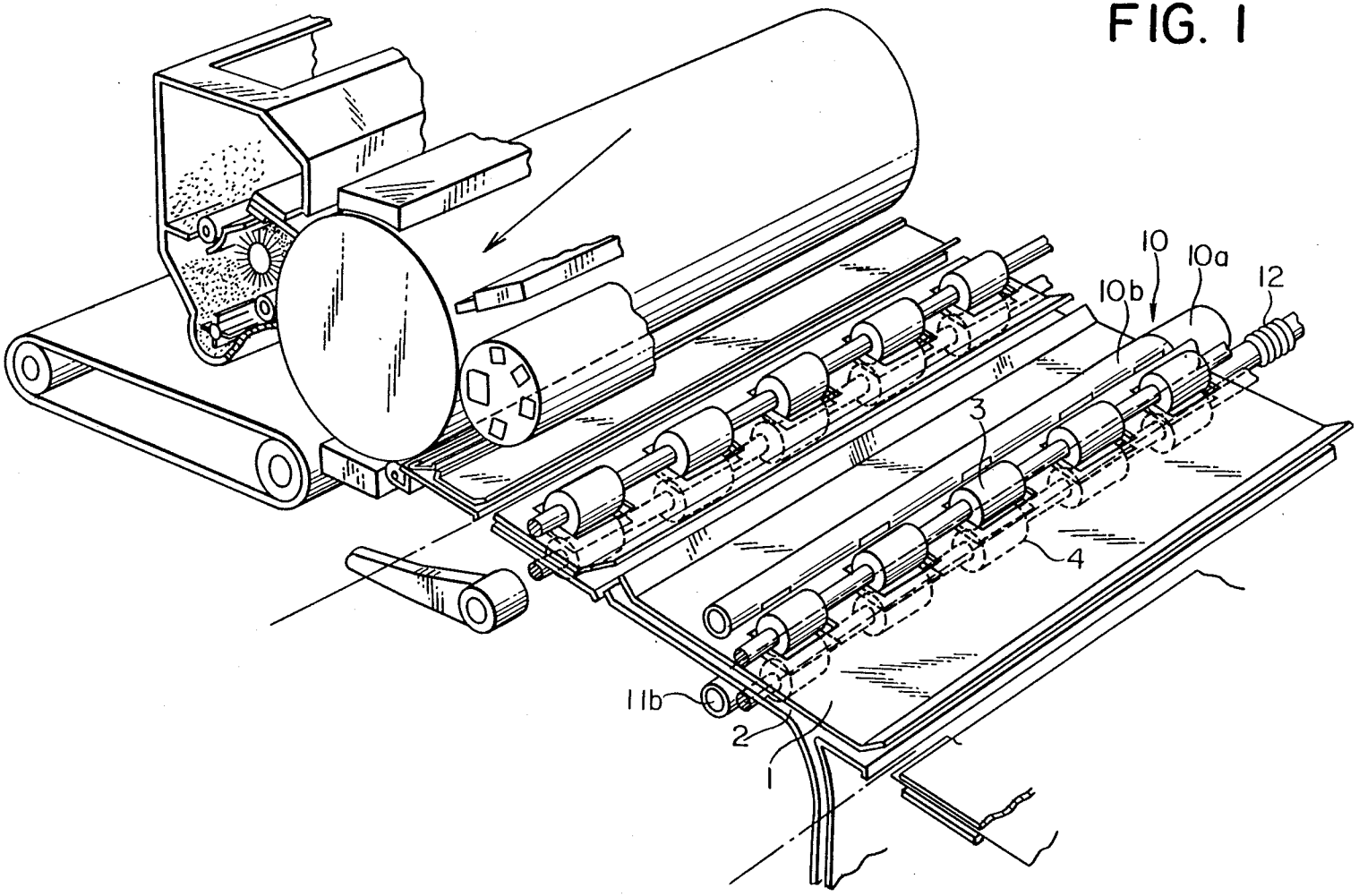
FIG. 1 is a perspective side view schematically illustrating a sheet conveyance apparatus according to the present invention.

One embodiment according to the invention is hereinunder described referring to the drawings.

The drawings jointly illustrate a copying sheet conveyance apparatus according to the invention which is attached to an electrophotographic copying apparatus. As indicated with dashed lines in FIGS. 1 and 2, the copying sheet conveyance apparatus is located, in an electrophotographic copying apparatus, between a sheet feed apparatus A, such as a copying sheet feed cassette, and an image forming portion B where a toner image is formed on the surface of a fed copying sheet, whereby the copying sheet conveyance apparatus conveys a copying sheet fed from the sheet feed apparatus A to a transfer/separation portion which the image forming portion B constitutes. Under the sheet conveyance apparatus is provided an intermediary stacker which is used to form images on both sides of a copying sheet.

The sheet conveyance apparatus is located, as illustrated in the FIG. schematically illustrating its general arrangement, adjacent to the sheet feed apparatus A on the main body of an electrophotographic copying apparatus, and comprises, at its sheet feed apparatus A side, a first pair of upper and lower guide plates 1 and 2, whereby in the center portion of the first pair of upper and lower guide plates 1 and 2 are disposed a pair of upper and lower conveyance rollers 3 and 4.

The inlet side of the upper guide plate 1, in terms of conveyance direction, constitutes a junction which receives a copying sheet fed from the sheet feed apparatus A. The junction portion la capable of being pivotally elevated and depressed around a shaft S and is normally in the position indicated in FIG. 2 with solid lines. However, when pressed with the leading edge of a fed copying sheet, this portion 13 is capable of shifting to the position indicated with dashed lines.

To the passage formed between the first pair of upper and lower guide plates is connected a passage C in which a copying sheet already having a copied image on one side thereof is transported in the course of a duplex copying operation.

In an area at the downstream side of the above-mentioned pair of conveyance rollers 3 and 4 on the above-mentioned first pair of upper and lower guide plates 1 and 2, the first upper guide plate 1 stands upward and forms a wider passage.

At the base portion of the standing part are disposed a plurality of plate-shaped presser members 5, composed of a material such as Mylar, with specified intervals in the transverse direction.

The end of the first lower guide plate 2, in the forward portion relative to the sheet transportation direction, forms a slight upward slope. This area serves as a directional guide for a copying sheet.

Following the pair of first upper and lower guide plates 1 and 2, and further forward in the sheet transporting direction, is a pair of second upper and lower guide plates 6 and 7. Among these second guide plates 6 and 7, one edge of the second upper guide plate 6 adjacent to the standing part of the first upper guide plate 1 also stands upward. In contrast, the first lower guide plate 2 together with the second lower guide plate 7 form a substantially flat bottom of a sheet transporting passage. In short, both standing portions of the first upper guide plate 1 and the second upper guide plate 6 form a hill-shaped interfacing portion, or a wider passage therebetween.

In the area of the pair of second upper and lower guides plates 6 and 7 are provided a pair of upper and lower registration rollers 8 and 9, whereby the pair of second upper and lower guide plates 6 and 7, together with the pair of upper and lower registration rollers 8 and 9, constitute the registration portion.

In other words, the sheet conveyance apparatus of the invention is composed of two conveyance parts, wherein the interfacing portion constitutes a hill-shaped passage and each of two conveyance parts is provided with a pair of rollers.

Figure 14:
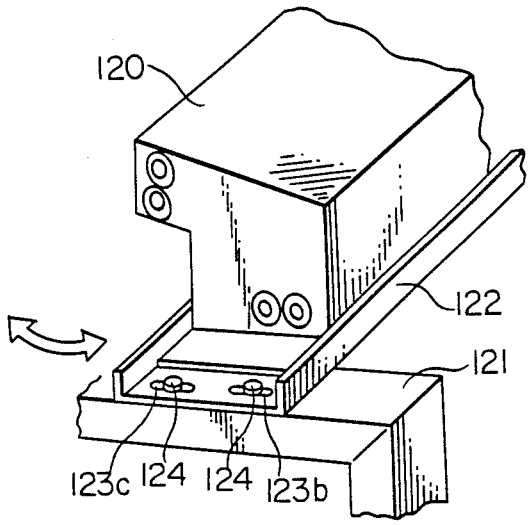
FIG. 14 is a perspective side view schematically illustrating both a supporting frame and a part of a the main body of copying apparatus.
Figure 15:
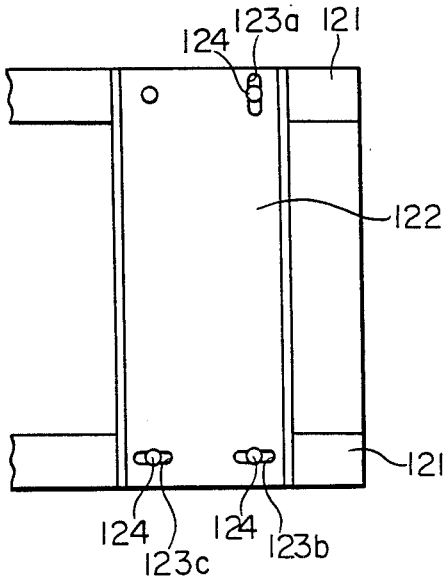
FIG. 15 is a plan view illustrating the area shown in FIG. 14.

The members constituted as described above are pivotally movable in a horizontal plane within the above-mentioned electrophotographic copying apparatus as one unit around one specific corner among the four corners, and may be secured in an arbitrary position. More specifically, as shown in FIGS. 14 and 15, a frame 120 located on the upper surface of a base plate 122, which is located on the upper surface of a portion 121 of the main body 121 of the copying apparatus, supports the respective members, and the base plate 122 has, on three among the four corners, slots 123*a*, 123*b* and 123*c*, wherein the slots 123*b* and 123*c* on one side are arranged at a perpendicular angle relative to the other slot 123a. The base plate 122 is mounted onto the portions 121 on the main body of the copying apparatus with screws 124, whereby the base plate 122 being positioned on the portions on the main body is capable of either moving in a horizontal plane or being fixed by virtue of the slots 123*a*, 123*b* and 123*c* as well as the screws 124.

Being adjacent to the pair of first upper and lower guide plates 1 and 2, and at the forward portion in sheet transporting direction, suction tubes 10 and 11 respectively having an opening facing the conveyance rollers 3 and 4 are disposed in parallel with these rollers 3 and 4.

Figure 4:
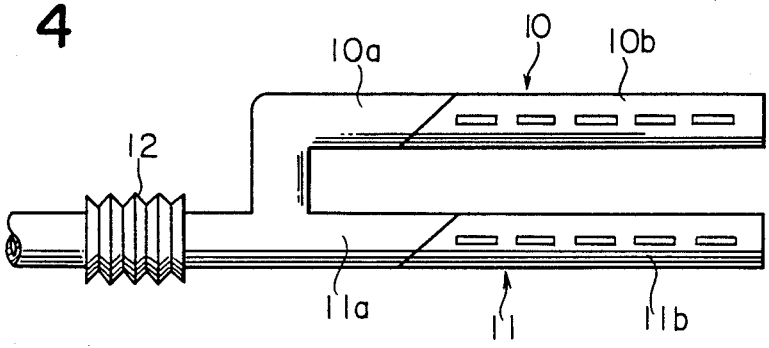
FIG. 4 a general view illustrating a suction tube.
Figure 10:
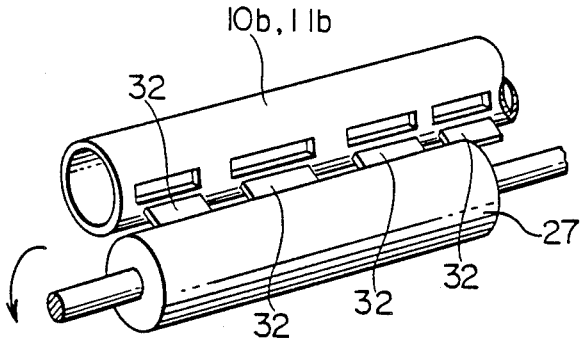
FIG. 10 illustrates the interrelation among a suction tube, a paper dust beater member and an agitator.

The suction tube 10 (or 11) comprises a portion 10*a* (or 11*a*), secured on the main body of the copying apparatus, as well as a portion 10*b* (or 11*b*) which is located adjacent to a paper dust beater member 27 as shown in FIG. 10, wherein the portion retained on the main body of the electrophotographic copying apparatus includes a flexible deformable portion in the middle thereof. The obliquely cut ends of the portions 10*a* and 10b (or, 11*a* and 11*b*) provide a continuous tube when pressed together or a gap when separated (see FIGS. 1 and 4).

Figure 5:
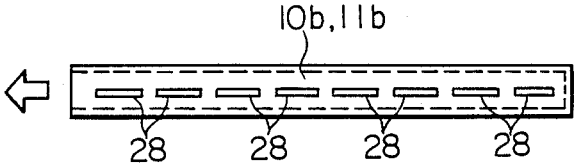
FIGS. 5, 6 and 7 individually illustrate the principal area on a suction tube.
Figure 6:
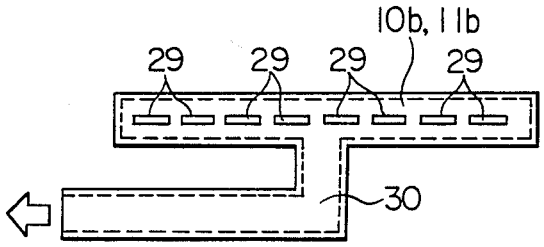
Figure 7:
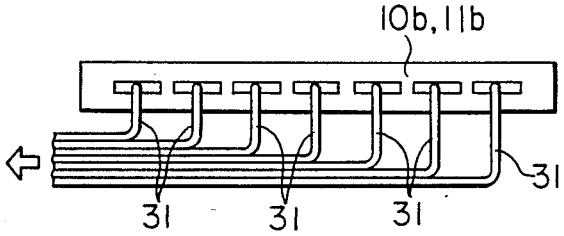
Figure 8:
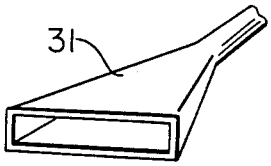
FIG. 8 illustrates the opening on each of tubular members illustrated in FIG. 7.

The possible modified configurations of the suction tube are as follows: as shown in FIG. 5, a plurality of slits 28, 28, . . . respectively having a different length sequentially formed, in the order or length, respectively on portions 10*b* and 11*b* which are adjacent to the paper dust beater member 27, wherein a suction flow is directed outside via one end of the suction tube; as shown in FIG. 6, each of the portions 10*b* and 11*b* is provided with a plurality of slits 29, 29, . . . , wherein a tube member 30 for suction flow is connected to the middle of the portions 10*b* and 11*b*; as shown in FIG. 7, the slits are individually connected to respective tube members 31, 31, . . . having a connection opening shown in FIG. 8. To ensure a uniform flow rate per each slit, the longer the flowing paths of the slits, the sizes of the slits are proportionally larger.

Figure 2:
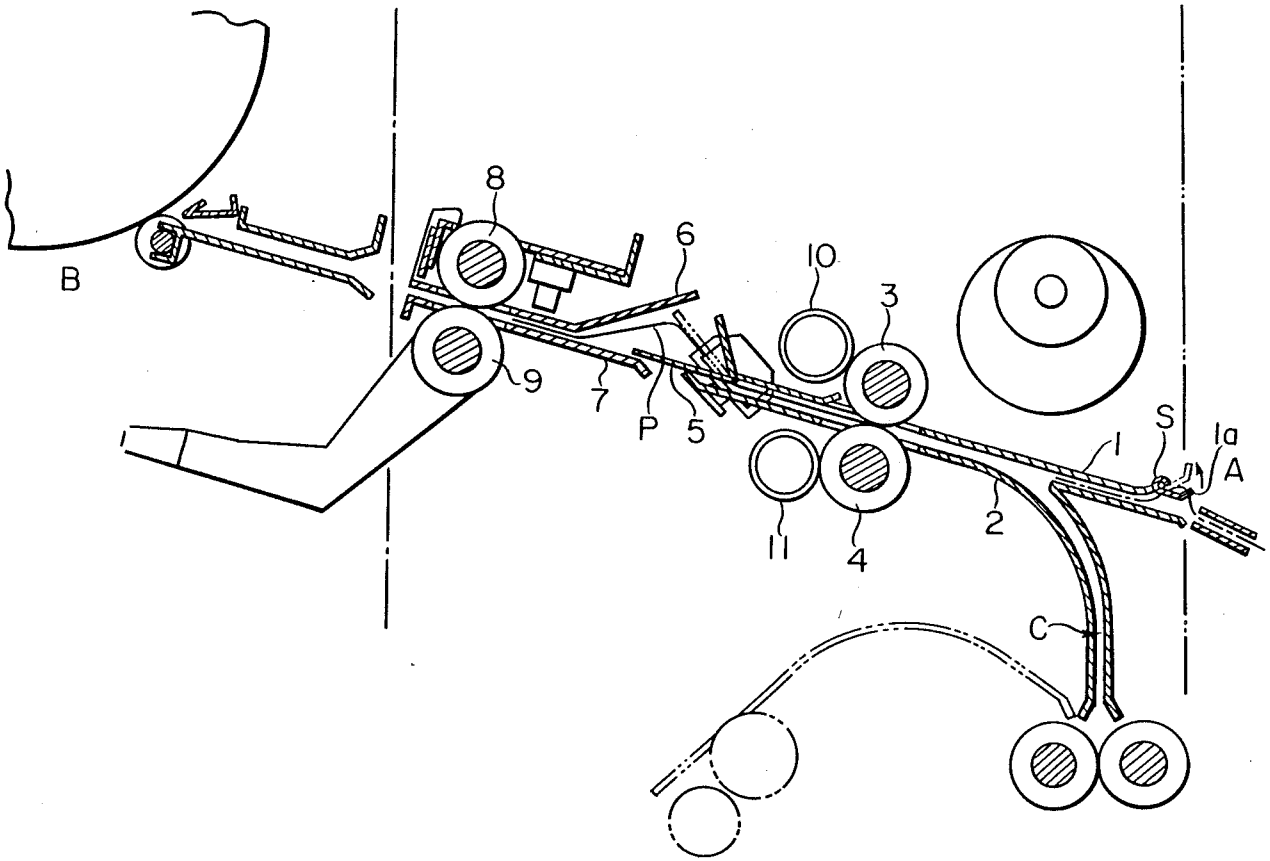
FIG. 2 is a longitudinal cross section illustrating the apparatus shown in FIG. 1.
Figure 3:
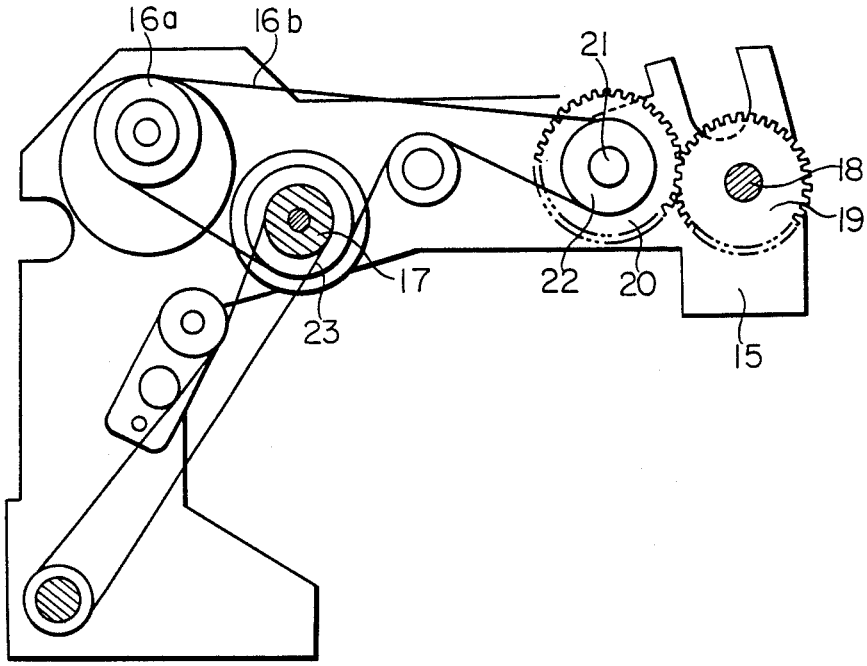
FIG. 3 is a rear view of the apparatus shown in FIGS. 1 and 2.

Among the portions through which the sheet conveyance apparatus is mounted onto the main body of the electrophotographic copying apparatus, the portion to the far side in FIG. 1 is provided with a support plate 15 of which configuration seen from the far side is illustrated in FIG. 3, wherein the support plate 15 is provided with a driver unit 16*a* as a driving source.

The driving unit 16*a*, unlike a driving unit for driving an image-carrying member provided on the main body of the electrophotographic copying apparatus, is a driving unit exclusively used for driving the sheet conveyance apparatus of the invention. The driving force of the driving unit 16*a* is transmitted via a belt 16*b* and drives via a loop clutch 23 a shaft 17 of the upper conveyance roller 3 among the pair of upper and lower conveyance rollers 3 and 4 disposed on the pair of upper and lower guide plates 1 and 2 on the sheet feed apparatus A side, as well as via a registration clutch 22 a shaft 21 of a gear 20 being meshed with a gear 19 on a shaft 18 of the registration roller 8 among the pair of upper and lower registration rollers disposed on the pair of upper and lower guide plates on the image-forming portion B side. The driving force of the driving unit 16 is at the same time transmitted to a roller for a sheet conveyance passage for a duplex copying operation.

Figure 9:
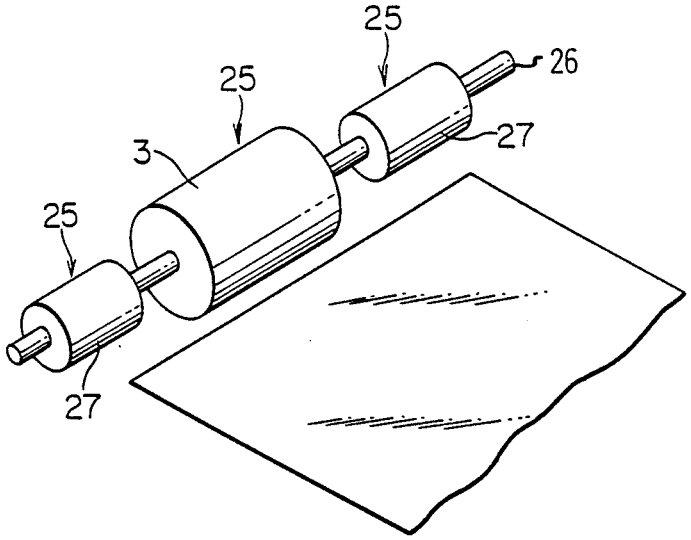
FIG. 9 illustrates the relation between a conveyance roller and a paper dust beater member.

The diameters of the pair of upper and lower conveyance rollers 3 and 4, disposed along the widthwise direction of a transported copying sheet at the middle portion of the pair of first upper and lower guide plates 1 and 2, are not uniform. More specifically, each of these rollers 3 and 4 comprises a plurality of rollers 25, 25, . . . each having a specific length and disposed on a shaft 26 as shown in FIG. 9. These rollers 25, 25, . . . include those serving as the conveyance roller 3 as well as those individually serving as a paper dust beater member 27 which removes the dust derived from copying sheets. Each sheet is transported while the middle zone of the sheet is held between the conveyance rollers, and, at the same time, the rollers serving as paper dust beater members 27 are in contact with both the side zones of the sheet (see FIG. 9).

According to this arrangement, an electrically conductive fur brush is used as the paper dust beater member 27, and, this allows an electrical charge on each copying sheet to be neutralized.

Correspondingly, the paper dust beater member 27 may be a roller made of a foamed material as far as the material is an electrically conductive material.

Paper dust adhering to the paper dust beater member is drawn into the suction tubes 10*b* and 11*b*. To completely remove the paper dust on the paper dust beater member 27, agitators (paper dust scraper members) 32, 32, . . . coating the paper dust beater member 27 are incorporated (see FIG. 10).

More specifically, these agitators 32, 32, . . . are disposed between the suction tubes 10*b* and 11*b* and the paper dust beater member 27, wherein the agitators 32, 32, . . . beat the paper dust beater member 27 in conjunction with the rotation of the paper dust beater member 27, in order to remove the dust adhering to the member 27 and allow the dust to be drawn into the suction tubes 10*b* and 11*b*.

As a result, the agitators 32, 32, . . . ensure the paper dust adhering to the paper dust beater member 27 to be readily collected into the suction tubes.

With this arrangement, being disposed coaxially with and adjacent to the conveyance roller 3, the rollers serving as the paper dust beater members 27 collect the paper dust. This arrangement allows a common driving unit to drive both the conveyance roller 3 and the paper dust beater members 27, and hence a small space to be required. However, both the paper dust beater members 27 and the conveyance roller 3 may be or may not be rotated on a common axis of rotation. The paper dust beater member may be made of a foamed material such as foamed urethane, wherein an electrifying unit may be incorporated in order to electrify the foamed material; or, a paper dust beater member may be made of a material such as an electrically conductive fur brush or sponge.

Figure 11:
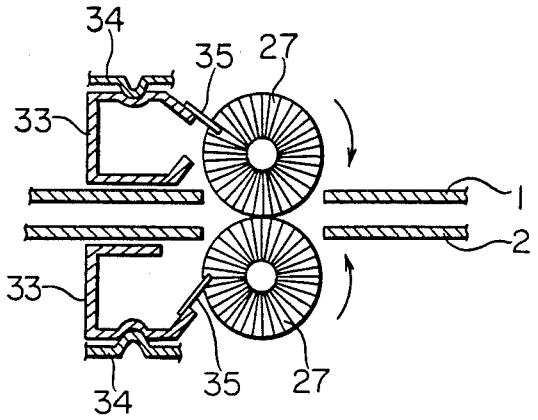
FIG. 11 illustrates the relation between a paper dust beater member and a paper dust container.
Figure 12:
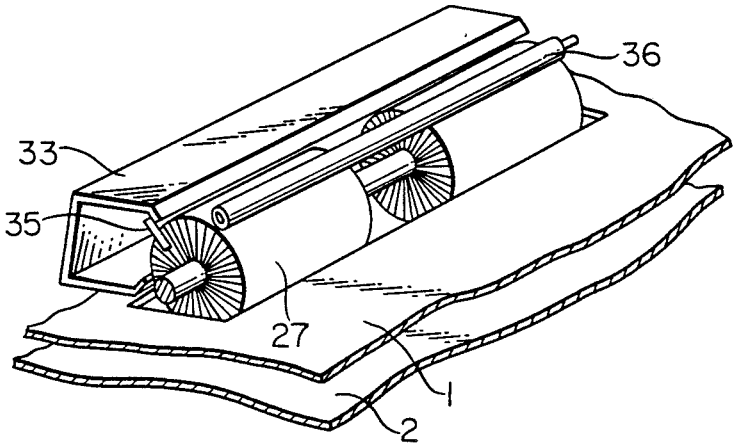
FIG. 12 illustrates the interrelation among a paper dust beater member paper dust container and an auxiliary electrifier member.

FIGS. 11 and 12 independently illustrate means, without a suction tube, for collecting dust adhering on the paper dust beater member 27. The means in FIG. 11 extends along the width direction relative to a copying sheet, and is provided with dust containers 33 respectively having an opening adjacent to the paper dust beater member 27, wherein the containers 33 are respectively detachable by means of a click plate 34, and a specific portion of each container 33 is provided with an agitator 35 which is always in contact with the paper dust beater member 27.

Accordingly, even a construction without a suction tube which has the previously mentioned arrangement is capable of positively collecting paper dust into the container 33 without contaminating other areas.

The means in FIG. 12 is additionally provided with an auxiliary electrifying member 36, wherein the auxiliary electrifying member 36 electrifies a paper dust beater member 27 made of resin fibers in order to ensure paper dust collection.

Accordingly, when the paper dust beater member 27 is made of acrylic resin, and if a copying sheet has a negative (−) electrical potential, the auxiliary electrifying member 36 is made of polyethylene or the like; if a copying sheet has a positive (+) electrical potential, the auxiliary electrifying member 36 is made of rayon or the like.

Additionally, the paper dust beater member 27 is preferably a member which does not hinder the sheet conveyance with conveyance rollers. Therefore, the diameter of a preferred beater member 27 is identical with or smaller than that of a conveyance roller if coaxial with the conveyance roller (see FIG. 9).

Figure 16:
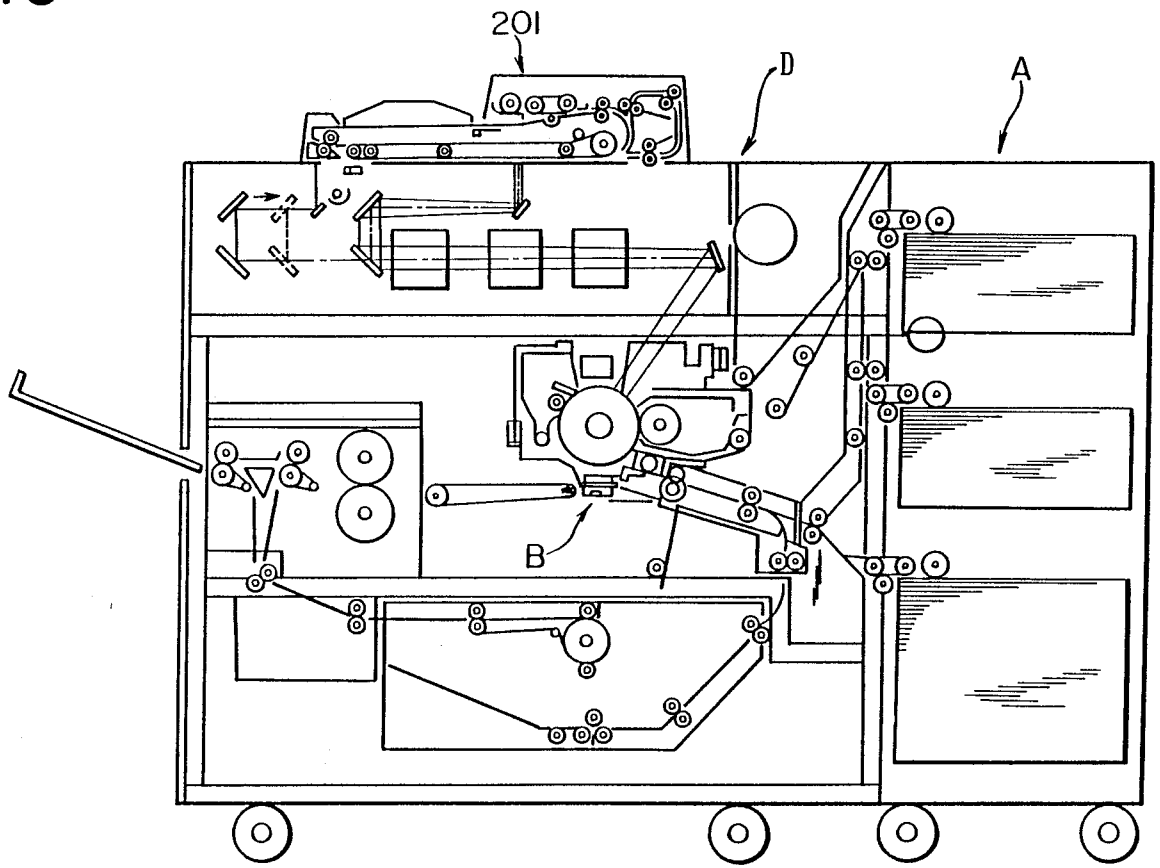
FIG. 16 is a perspective side view schematically illustrating a whole arrangement combining an electrophotographic copying apparatus with the sheet conveyance apparatus according to the present invention.

Incidentally, FIG. 16 shows an outline of the entire arrangement of the apparatus according to the invention which is composed of an electrophotographic copying machine D being provided with an automatic document feeder (ADF) 201 thereon, and the copy sheet feeder A being provided with a plurality of sheet cassette therein.

Next, operation of the above-mentioned components is described.

First, once a copying sheet is fed from a sheet feed apparatus A which is disposed in the sheet feed side on an electrophotographic copying apparatus, the copying sheet is transported while being kept between a pair of upper and lower guide plates 1 and 2, and then reaches a pair of upper and lower conveyance rollers 3 and 4.

During this course, the leading edge of a copying sheet transported from the sheet feed apparatus A at first comes into contact with a portion la of the upper guide plate 1. The portion 1*a* is capable of lifting upward due to the stiffness of the sheet. However, the stiffness of the sheet is not so large as to completely open up this portion 1*a*. Accordingly, the leading edge of the sheet is directed into the space between the upper and lower guide plates 1 and 2, whereby the loop formed by the sheet and positioned in the area between the sheet feed apparatus A and the guide plates 1 and 2 is not crushed.

In the above description, the portion 1*a* of the upper guide plate is made of a rigid plate capable of being pivotally lifted or depressed around pivot S. However, a flexible sheet and the like may be connected to the edge of the upper guide plate 1 in place of the rigid plate so as to let the sheet form the loop.

With a pair of the upper and lower conveyance rollers 3 and 4, the diameters of roller components are not uniform along the widthwise direction of a sheet; each of these roller component comprises a plurality of rollers 25, 25, . . . , wherein not all the rollers are employed for transporting the copying sheet. A middle roller 25 serves as the conveyance roller 3, and other rollers 25 located on both sides of the conveyance roller 3 serve as the paper dust beater members 27.

A copying sheet comes into contact with various members in the course of being conveyed, and produces paper dust which adheres to the sheet. Accordingly, if not removed, the dust may fly around freely, as the sheet is transported, and contaminate various members.

Accordingly, the paper dust adhering to the copying sheet is removed with the paper dust beater member 27. This procedure is performed while the sheet is conveyed, and does not hinder the sheet conveyance at all.

The copying sheet, having been transported while retained in the passage formed between the pair of upper and lower guide plates 1 and 2, leaves the guide plates 1 and 2. As it slides on the upper face of the lower guide plate 2, the copying sheet reaches the slightly upward-directed portion of the end of the lower guide plate 2 which directs the sheet upward in the outlet area of the passage between the guide plates 1 and 2. The sheet is also directed upward due to the similarly upward-directed portion of the end of the upper guide plate 1.

If there is not provided such an upwardly-directing portion, various kinds of loops may be formed due to the stiffness of the sheet or the wetness of sheet, resulting in that sheet conveyance may be adversely affected. On the contrary, because such an upwardly-directing portion is provided according to the invention, the sheet is so guided to consistently form same type of loop.

When the upward-directed leading edge of the copying sheet comes in contact, by means of the presser member 5, with the inclining portion of the second upper guide plate 6, the leading edge is directed downward along the inclining portion. Correspondingly, the copying sheet is directed into the passage formed between the second upper and lower guide plates 6 and 7, and, therefore, a portion of the sheet located in this interfacing area always forms a loop, and, simultaneously, the leading edge of the sheet comes into contact with a pair of upper and lower registration rollers 8 and 9. Thus, the possible misorientation in the sheet is corrected, and then the sheet is transferred to the image-forming portion B on the electrophotographic copying apparatus.

Subsequently, an image is formed on the sheet in the image-forming portion B, fixed with a fixing unit, and ejected outside the copying apparatus.

As described above, a copying sheet passes through the sheet conveyance apparatus according to the invention often it is fed by the sheet feed apparatus A, and is transferred to the image-forming portion on the electrophotographic copying apparatus. In the sheet conveyance apparatus of the invention, the pair of upper and lower registration rollers 8 and 9 are located at the side adjacent the image-forming portion B. The pair of upper and lower conveyance rollers 3 and 4 are located at the other side of the sheet feed apparatus A, and simply serve as conveyance rollers, whereby a copying sheet fed by the sheet feed apparatus A is first conveyed by the pair of upper and lower conveyance rollers 3 and 4, and during this course, the paper dust is removed. In the final portion of the passage formed between the upper and lower guide plates 1 and 2, the copying sheet is directed upward by the lower guide plate 2 as well as by the upward-directed portion of the upper guide plate. The sheet then reaches the upper end of the second upper guide plate 6, while guided by the presser member 5 made of Mylar material or the like attached to the base portion of the standing part of the upper guide plate 1. Since the upper guide plate 6 guides the sheet downward, the previously upward-directed sheet forms a loop in this loop-forming portion, and moves downward. Then the leading edge of the sheet reaches an area between the registration rollers 8 and 9 and halts here. This arrangement corrects the possible misorientation in the sheet.

Figure 13:
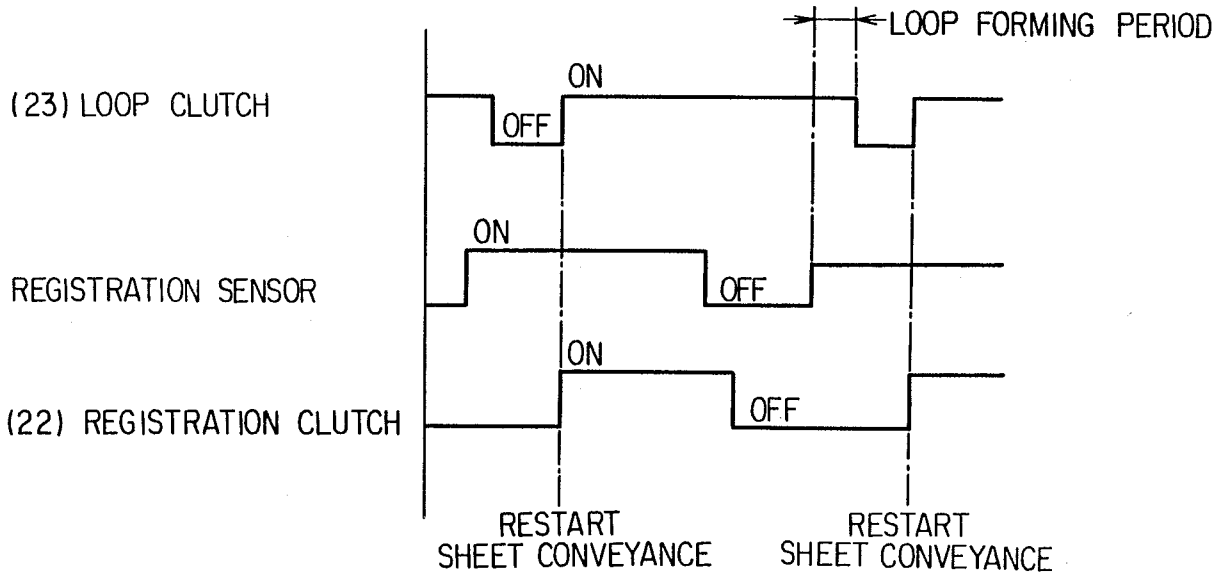
FIG. 13 illustrates the driving timing according to which conveyance rollers and registration rollers are driven.

The operational timing for the conveyance rollers 3 and 4, and the registration rollers 8 and 9, is as shown in FIG. 13. Based on the signal from a registration sensor not shown located in the passage formed between the second guide plates 6 and 7, the clutches 22 and 23 are either turned on or off.

Incidentally, it may be preferable to attach a flexible member such as Mylar and the like to the upwardly-directing portion of the lower guide plate 2. If the upwardly-directing portion is made of the flexible member, when registration rollers transport the sheet, rubbing force taking place between the upwardly-directing portion and the sheet may be kept at a minimum level due to deflection of the flexible member.

As shown in FIG. 13, the registration sensor disposed in the passage formed between the second guide plates 6 and 7 detects the copying sheet transported and, after a specific period, turns off the loop clutch 23 in order to halt the pair of upper and lower conveyance rollers 3 and 4. Since the registration clutch 22 is in the off status at this point, the sheet is stopped and waits for another action while the sheet has been formed into a loop at the interfacing area in the passage which is formed among the guide plates 1, 2, 3 and 4.

Then, once the sheet conveyance is restarted, the clutches 22 and 23 are simultaneously actuated, driving the pair of the upper and lower conveyance rollers 3 and 4 as well as the pair of upper and lower registration rollers 8 and 9 at a uniform speed and transfers the sheet to the image-forming portion B. Accordingly, a loop formed with a portion of the sheet located inside the hill-shaped loop-forming portion arranged in the passage is always present. Therefore, a noise, usually caused by pulling the leading edge of a copying sheet faster than the trailing edge in order to remove the loop, does not occur, because the loop is always present. In essence, the sheet conveyance apparatus of the invention ensures quiet sheet conveyance operation.

Additionally, during the sheet conveyance operation, even if the conveyance speed of the conveyance rollers 3 and 4 differs from that of the registration rollers 8 and 9, the sheet is transported with a loop stably maintained, as described above. Furthermore, the gap formed between both the upper guide plates 1 and 6 positively prevents an excessive tension from being exerted on the sheet by either the conveyance rollers 3 and 4, or the registration rollers 8 and 9, and ensures the stable sheet conveyance operation.

Even when a misorientation occurs with a copying sheet, the misorientation is corrected by horizontally moving the positional relation of the unit being incorporated with the pair of second upper and lower guide plates 6 and 7 supporting the pair of upper and lower registration rollers 8 and 9, and the pair of upper and lower guide plates 1 and 2.

The line speed of the pair of upper and lower conveaynce rollers 3 and 4 is identical with that of the pair of the upper and lower registration rollers 8 and 9. Accordingly, as mentioned previously, a loop formed as enclosed among both pairs of upper and lower guide plates is always present in the position, whereby the copying sheet is stably transported.

Accordingly, the noise otherwise occurring when the leading edge is pulled is positively eliminated.

According to the above-described construction of the invention, a constantly slack copying sheet is transported, without receiving an excessive tension; even if a transportation speed of a pair of conveyance rollers is different from that of the other pair of rollers, a copying sheet is stably transported without receiving an excessive force. Accordingly, the invention provides excellent effects; for example, a finally formed image is free from the adverse influence possibly arising in the course of sheet transportation.

The sheet conveyance apparatus according to the present invention has a construction comprising an independent stacker for a duplex-copying operation as well as an independent sheet feed unit. This construction eliminates a conventional requirement for setting a time, such as a loop time, for each sheet transporting portion. Additionally, with a conventional sheet conveyance apparatus, though a common registration roller is used, a different loop-forming roller is provided for each combination of an ADU, large-capacity auxiliary sheet feed tray, and sheet feed cassette, and, accordingly, a resistance in transporting a sheet differs from combination to combination due to a setting angle relative to the registration roller, shape of guide plate, line speed (since a sheet feed speed differs in compliance with a different passage length) or other factors. Therefore, the sheet feed condition (a loopforming time for always forming an identical size of a loop) should be strictly adjusted from unit to unit. Unlike such a conventional apparatus, within a sheet conveyance apparatus of the invention, a portion of a copying sheet located in the loop-forming portion is unconditionally formed into a loop while being transported, and temporarily kept stationary at the registration portion as the loop is maintained, and in this duration a possible misorientation in the sheet is corrected. Consequently, a loop is always present on a portion of a sheet to be further transported, and the positively eliminates any misorientation. In summary, the sheet conveyance apparatus of the invention has an outstanding effect; since the unit of the invention is independently provided, adjusting the unit readily corrects the misalignment in the optical system or the misoriented sheet even after the registration.

What is claimed is:

1. A sheet conveyance apparatus for a copy machine having a movable photoreceptor for forming a toner image thereon, comprising:

a sheet feed section including a plurality of tray accommodation means for respectively accommodating a sheet tray containing a stack of sheets, and a plurality of feed means associated, respectively, with said plurality of tray accommodation means for feeding a sheet to a sheet conveyance section, and said sheet conveyance section including guide means for forming a sheet conveyance passage common to said plurality of feed means, conveyance means disposed along said sheet conveyance passage for transporting to a registration means the sheet fed from said feed means, said registration means being disposed along said sheet conveyance passage for initially blocking movement of the sheet transported from said conveyance means along the sheet passage, and a selected time interval after the fed sheet reaches the registration means, conveying the blocked sheet to said photoreceptor so that the toner image is transferred onto the sheet, and said guide means having a loop-forming means between said conveyance means and said registration means for forming a loop in the fed sheet as it is transported by said conveyance means and blocked as its forward end by said registration means;

wherein said sheet conveyance section is formed as one unit and is capable of being adjusted to be located a selected position in relation to said photoreceptor independently from said sheet feed section.

2. The apparatus of claim 1, wherein said guide means comprises a pair of upper and lower horizontal guide plates.

3. The apparatus of claim 2, wherein said upper guide plate is generally hill-shaped.

4. The apparatus of claim 1, wherein said loop forming means includes a loop guiding means for changing the conveyance direction of the fed sheet so as to form a loop.

5. The apparatus of claim 4, wherein said loop forming means further includes a pressing means for pressing the loop-shaped sheet.

6. The apparatus of claim 5, wherein said pressure means is a flexible sheet.

7. The apparatus of claim 1, wherein a sheet receiving portion of said guide means is movable so as to widen the sheet conveyance passage in response to pressing force of the fed sheet.

8. The apparatus of claim 1, wherein said conveyance means comprises at least one conveyance roller having its axis of rotation arranged transversely of fed sheet, and said registration means comprises at least one registration roller having its axis of rotation arranged transversely of the fed sheet, and further comprising driving means for driving said at least one registration roller and said at least one conveyance roller, said driving means is independent of a driving means for said photoreceptor.

9. The apparatus of claim 1, wherein said sheet conveyance section comprises a paper dust beater member.

10. The apparatus of claim 9, wherein said paper dust beater member is a roller capable of coming in contact with the fed sheet.

11. The apparatus of claim 10, wherein said roller used as said paper dust beater member is coaxial with said at least one conveyance roller.

* * * * *